US006966814B2

(12) United States Patent
Mendel

(10) Patent No.: US 6,966,814 B2
(45) Date of Patent: Nov. 22, 2005

(54) HOOP-TYPE AMUSEMENT DEVICE

(76) Inventor: Nancy W. Mendel, 321 N. Lakeway, Palm Beach, FL (US) 33480

( * ) Notice: Subject to any disclaimer, the term of this patent is extended or adjusted under 35 U.S.C. 154(b) by 0 days.

(21) Appl. No.: 10/446,925

(22) Filed: Sep. 29, 2003

(65) Prior Publication Data

US 2005/0070202 A1 Mar. 31, 2005

(51) Int. Cl.[7] ..... A63H 1/00; A63H 33/00
(52) U.S. Cl. ..... 446/236; 446/487
(58) Field of Search ..... 446/85–128, 236, 446/266, 487; D21/684

(56) References Cited

U.S. PATENT DOCUMENTS 1,714,433 A * 5/1929 Molnar ..... 463/69
3,556,522 A * 1/1971 Gale ..... 472/116
3,802,978 A * 4/1974 Barnett ..... 156/96
4,020,589 A * 5/1977 Bravence et al. ..... 446/450
4,125,394 A * 11/1978 Wilson ..... 71/9
4,257,651 A * 3/1981 Griffith, Jr. ..... 301/58
4,655,723 A * 4/1987 Marason et al. ..... 446/241
4,822,315 A * 4/1989 Ben-Gal et al. ..... 446/102
5,282,767 A * 2/1994 Gelardi ..... 446/126
5,569,134 A 10/1996 Nordanger
5,601,470 A * 2/1997 Yao ..... 446/127
6,074,269 A * 6/2000 Rothbarth et al. ..... 446/268
6,309,273 B1 10/2001 Kim
6,312,305 B1 * 11/2001 McCormick et al. ..... 446/85
6,319,086 B1 * 11/2001 Shen ..... 446/236
6,431,939 B1 8/2002 Roh
6,491,563 B1 * 12/2002 Bailey ..... 446/122
6,516,833 B1 * 2/2003 Witz et al. ..... 138/135
6,533,635 B1 * 3/2003 Chern ..... 446/236

* cited by examiner

*Primary Examiner*—Derris H. Banks
*Assistant Examiner*—Faye Francis
(74) *Attorney, Agent, or Firm*—Mark D. Bowen, Esq.; Stearns Weaver Miller Weissler Alhadeff & Sitterson, P.A.

(57) ABSTRACT

An improved hoop-type amusement system is disclosed wherein a plurality of variously sized and shaped connectable components may be selectively interconnected by the user to form simple and complex hoop configurations of a particular size and complex geometric shape. Hoop components may have opposing ends that are adapted for mating engagement with other components to form a hoop of a particular size and shape. In addition, the hoop components may include a radially inner edge defining a recessed groove, and a radially outer edge defining a projecting tongue, or opposite variations thereof, thereby enabling the components to be connected with other components in tongue and groove engagement to form a wide variety of hoop configurations, whether annular or otherwise, thereby enhancing fun and enjoyment.

5 Claims, 14 Drawing Sheets

HOOP-TYPE AMUSEMENT DEVICE

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

This invention relates, in general, to hoop-type amusement devices and, more particularly, to an improved hoop-type device comprised of interconnected components of various shapes that may be disconnected, re-arranged, and re-connected into a wide variety of configurations.

2. Description of the Background Art

The HULA HOOP® is an amusement device that was initially introduced by Wham-O, Inc. in the early 1950's. HULA HOOP is a registered trademark of Wham-O, Inc. Since introduction, the HULA HOOP has enjoyed widespread use as a device for physical exercise and amusement used by men, women, and children of all ages. The classic HULA HOOP is formed from a hollow piece of plastic tubing having connected ends so as to form an annular shape having a fixed diameter. The HULA HOOP is generally placed around a users waist, legs, arms, or even neck, and user gyrations cause the hula hoop to rotate about the user.

While widely popular, the classic HULA HOOP is burdened with significant limitations. Specifically, the simple annular shape of the HULA HOOP limits its functionality and playing method, such that the user is merely able to rotate the hoop about their waist often causing the user to quickly become bored. Furthermore, the simple hoop structure is further incapable of adjustment of either size or shape thereby limiting appeal.

In an effort to overcome such disadvantages and limitations, a variety of improvements have been proposed and used in the art of hoop-type amusement devices. For example, in an effort to improve playability and/or enhance functionality, luminous hoops, glow-in-the-dark hoops, and fluid filled hoops have been developed and used in the art. Nevertheless, there exists a need for further improvements in technology relating to hoop-type play devices to enhance enjoyment and playability.

SUMMARY OF THE INVENTION

The present invention provides an improved hoop assembly formed from a plurality of variously sized and shaped connectable components that are selectively interconnected by the user to form a simple or complex hoop configuration of a particular size and shape. Accordingly, as used herein, the term "hoop" may refer to a wide variety of shapes, including annular, square, rectangular, triangular, polygonal, etc. A plurality of hoop components may have opposing ends that are adapted for mating engagement with other components to form a hoop of a particular size and shape. In addition, the hoop components may include a radially inner edge defining a recessed groove, and a radially outer edge defining a projecting tongue, or opposite variations thereof, thereby enabling the components to be connected with other components in tongue and groove engagement as more fully discussed herein below. The various components thus may be assembled into a wide variety of hoop configurations, whether annular or otherwise, thereby enhancing fun and enjoyment.

Accordingly, it is an object of the present invention to provide an improved hoop-type amusement device.

Another object of the present invention is to provide a hoop-type amusement device formed of a plurality of connectable components.

Still another object of the present invention is to provide a plurality of connectable components adapted for assembly by a user into a variety of hoop sizes and shapes.

Yet another object of the present invention is to provide a hoop assembly formed of connected components having radially inner and outer structures adapted for connecting various components, whether annular or otherwise, in a generally concentric configuration.

DETAILED DESCRIPTION OF THE INVENTION

Figure 1:
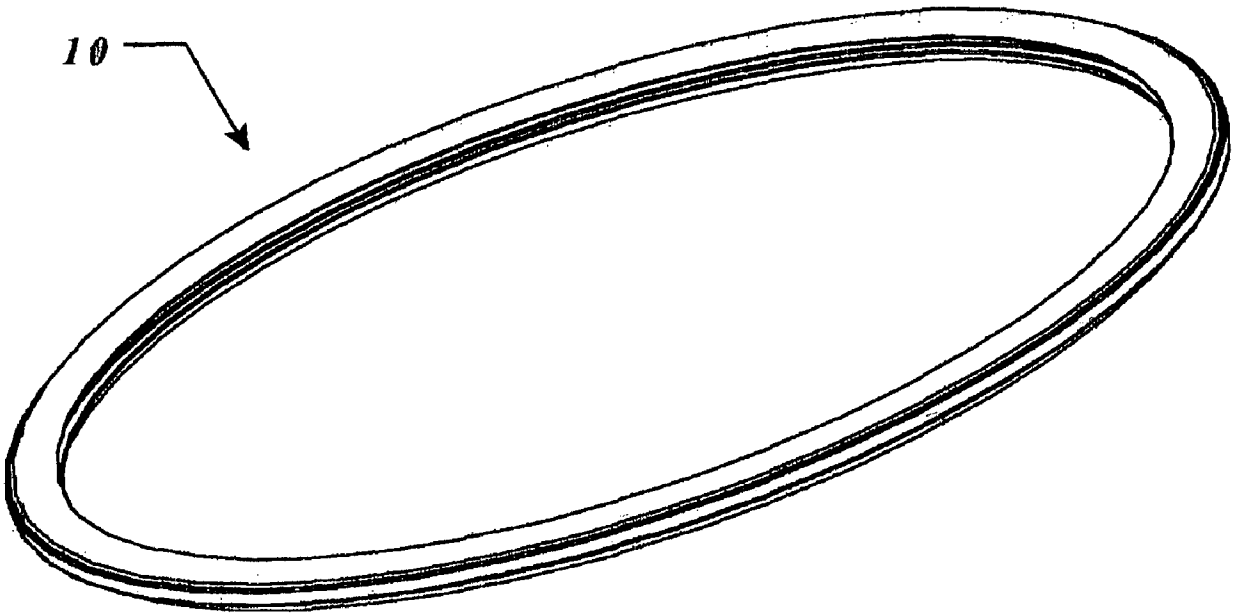
FIG. 1 is a top perspective view of an annular hoop component according to the present invention.
Figure 2:
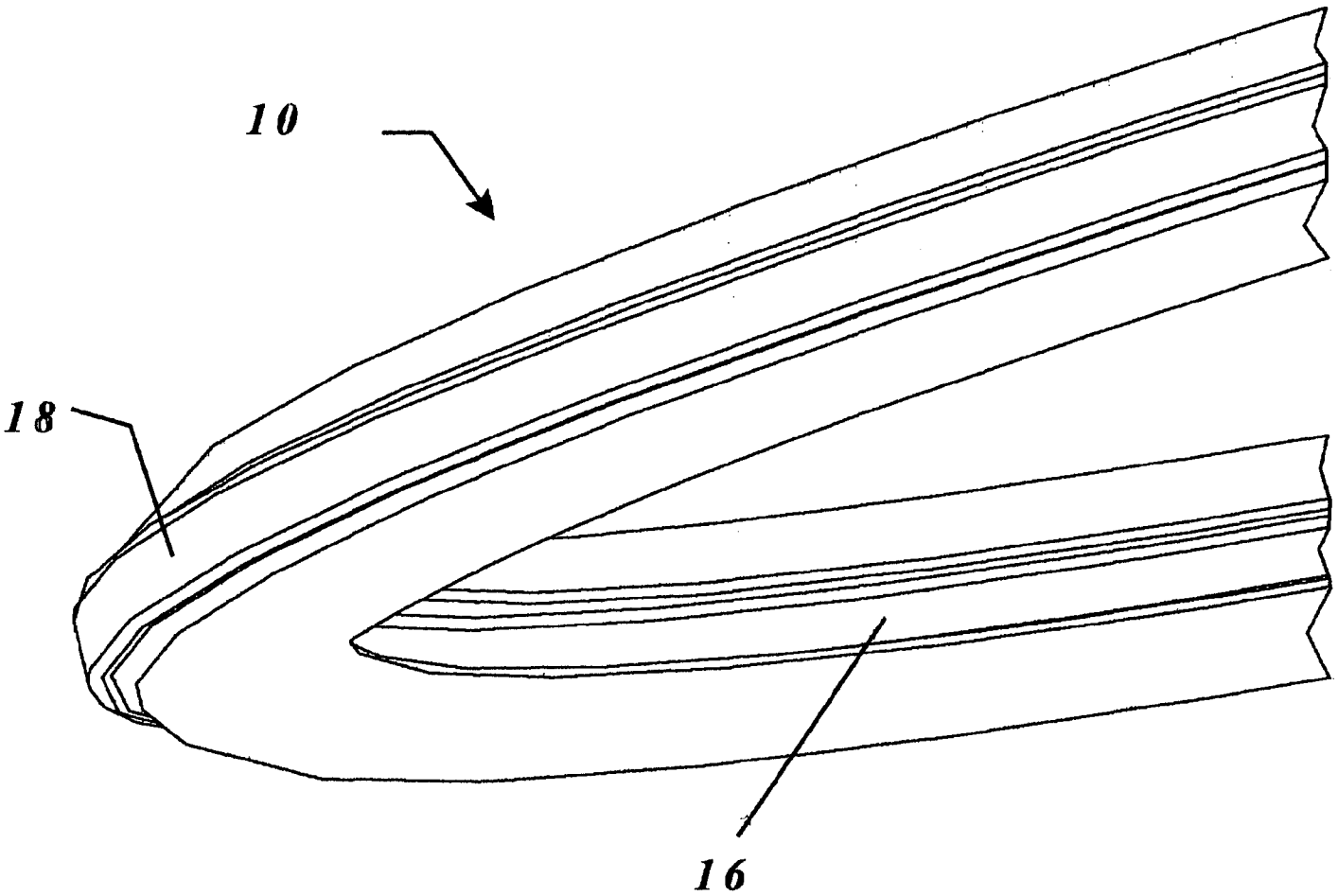
FIG. 2 is a bottom partial perspective view thereof.
Figure 3:
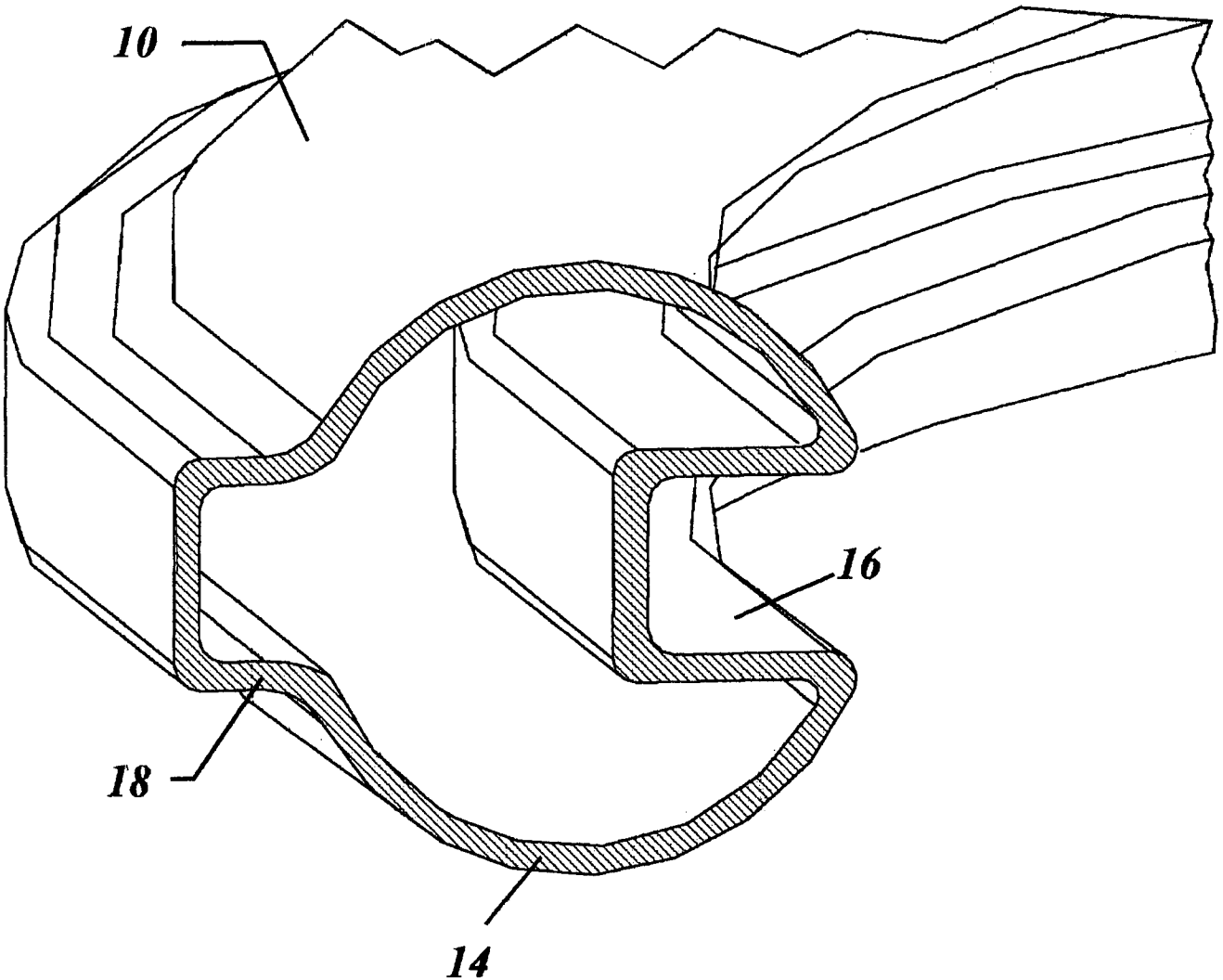
FIG. 3 is a cross-sectional view thereof.
Figure 4:
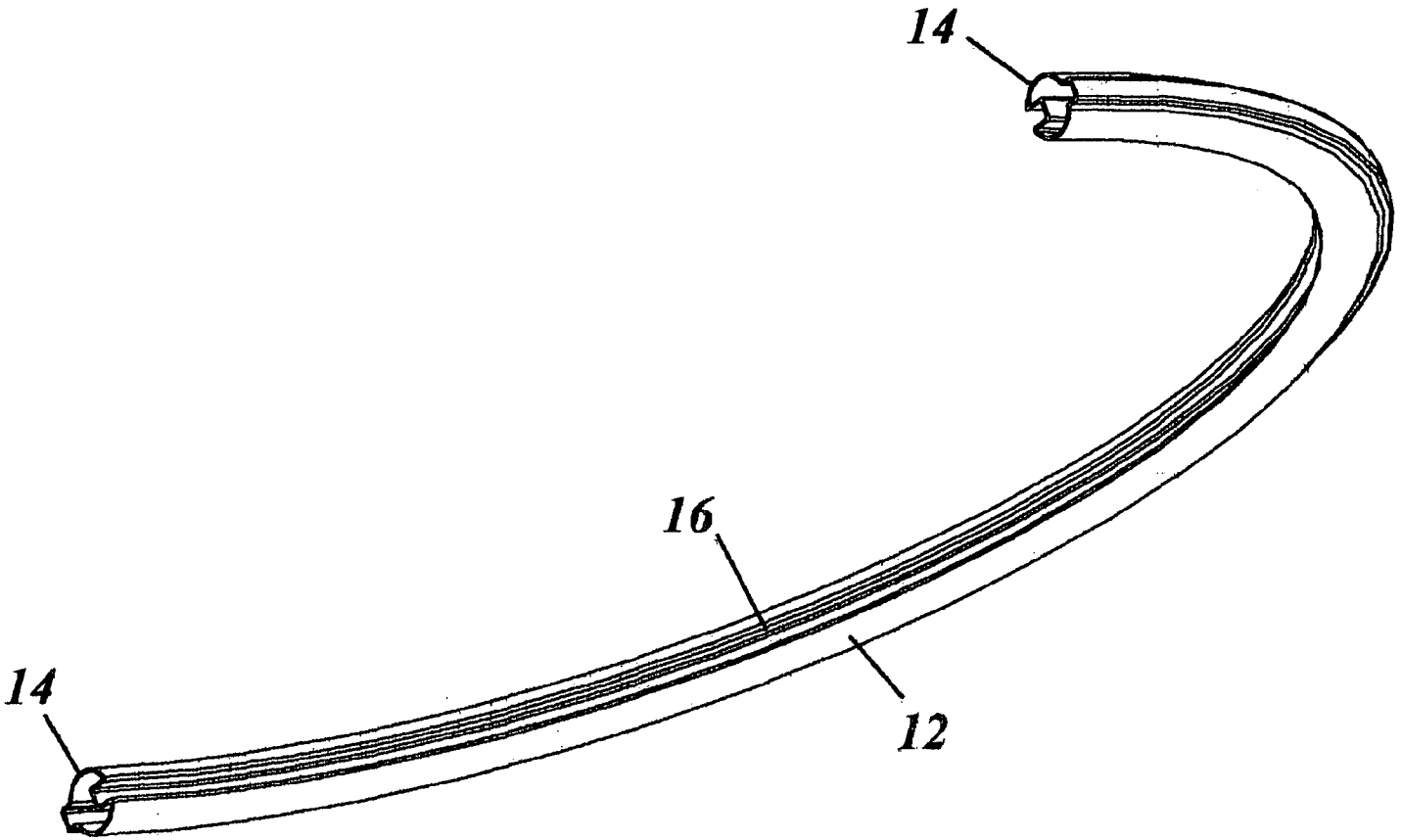
FIG. 4 is bottom cross-sectional perspective view thereof.

With reference now to the drawings there is depicted an annular component for a hoop-type amusement device according to the present invention, generally referenced as 10. As discussed herein above, the present invention primarily relates to the use of connectable components that are selectively configurable into variously sized and shaped hoop configurations, including composite configurations wherein annular components are connected with other annular and/or non-annular components to form more complex configurations. FIG. 1 illustrates an annular component 10 that forms a conventional annular hoop shape. As best depicted in FIGS. 2–4 hoop 10 is a generally hollow tube defined by a wall 12. Hoop 10 may be a unitary hoop and/or may be formed by connecting a plurality of arcuate segments, having opposing ends 14 that are adapted for mating engagement with other components to form a hoop of a particular size and shape.

In addition, the present invention contemplates hoop components that include an inner edge defining a recessed groove 16, and an outer edge 18 defining a projecting tongue as best illustrated in FIG. 3. The tongue and groove structures of the various components enable the components to be generally concentrically connected in tongue and groove engagement as more fully discussed herein below. The components may be of any suitable shape including: arcuate, straight, angular (obtuse, acute, or right angled), circular, square, rectangular, or polygonal. The components may be fabricated from hollow or solid plastic tubing, or from any other suitable material.

The invention may be more fully understood by reference to FIGS. 5–8 wherein various hoop configurations and components are disclosed.

EXAMPLE 1

Figure 5:
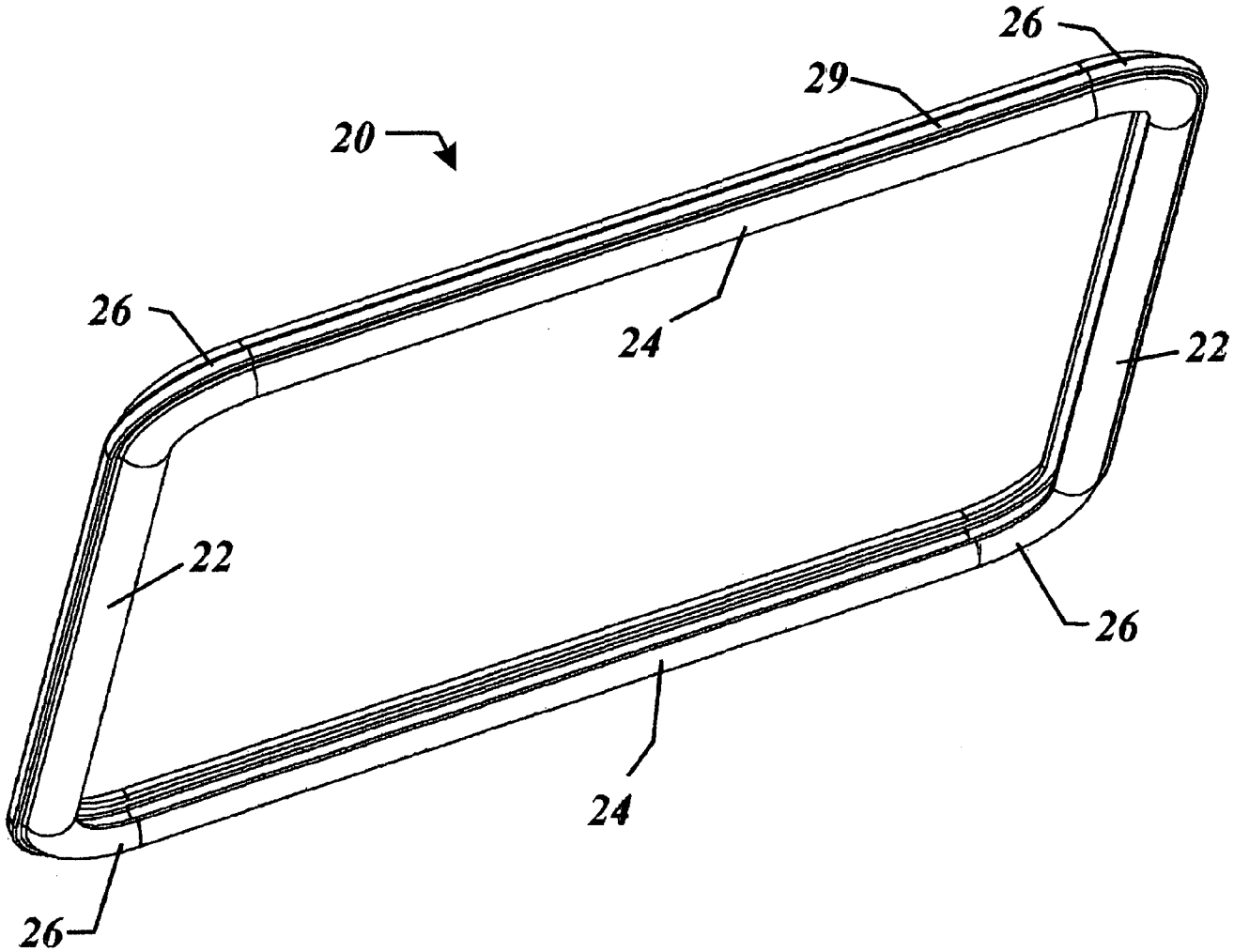
FIG. 5 is a bottom perspective view of a rectangular hoop configuration formed from a plurality of connected components.

FIG. 5 depicts a generally rectangular hoop configuration, generally referenced as 20, formed from eight (8) connected segments. The rectangular hoop configuration includes: a pair of short straight segments, referenced as 22; a pair of long straight segments, referenced as 24; and four ninety-degree angled segments, referenced as 26. Segments 22, 24 and 26 are connected to form a unitary component in an end-to-end manner by mating engagement of the component ends. The hoop segments each include an inner surface defining a recessed notch, generally referenced as 28, and an opposing outer surface defining a projecting tongue, referenced as 29.

EXAMPLE 2

Figure 6:
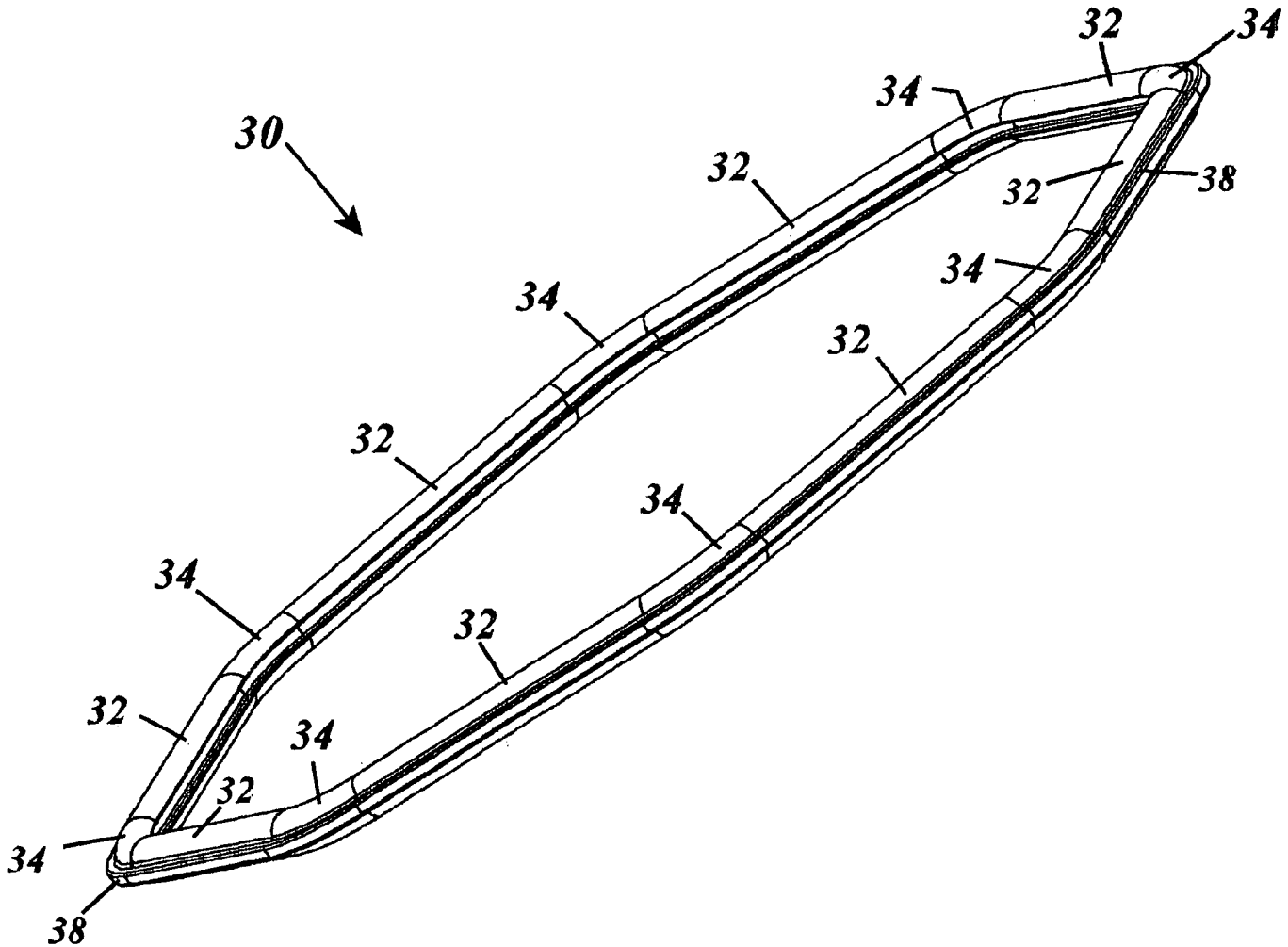
FIG. 6 is a top perspective view of an octagonal hoop configuration.
Figure 7:
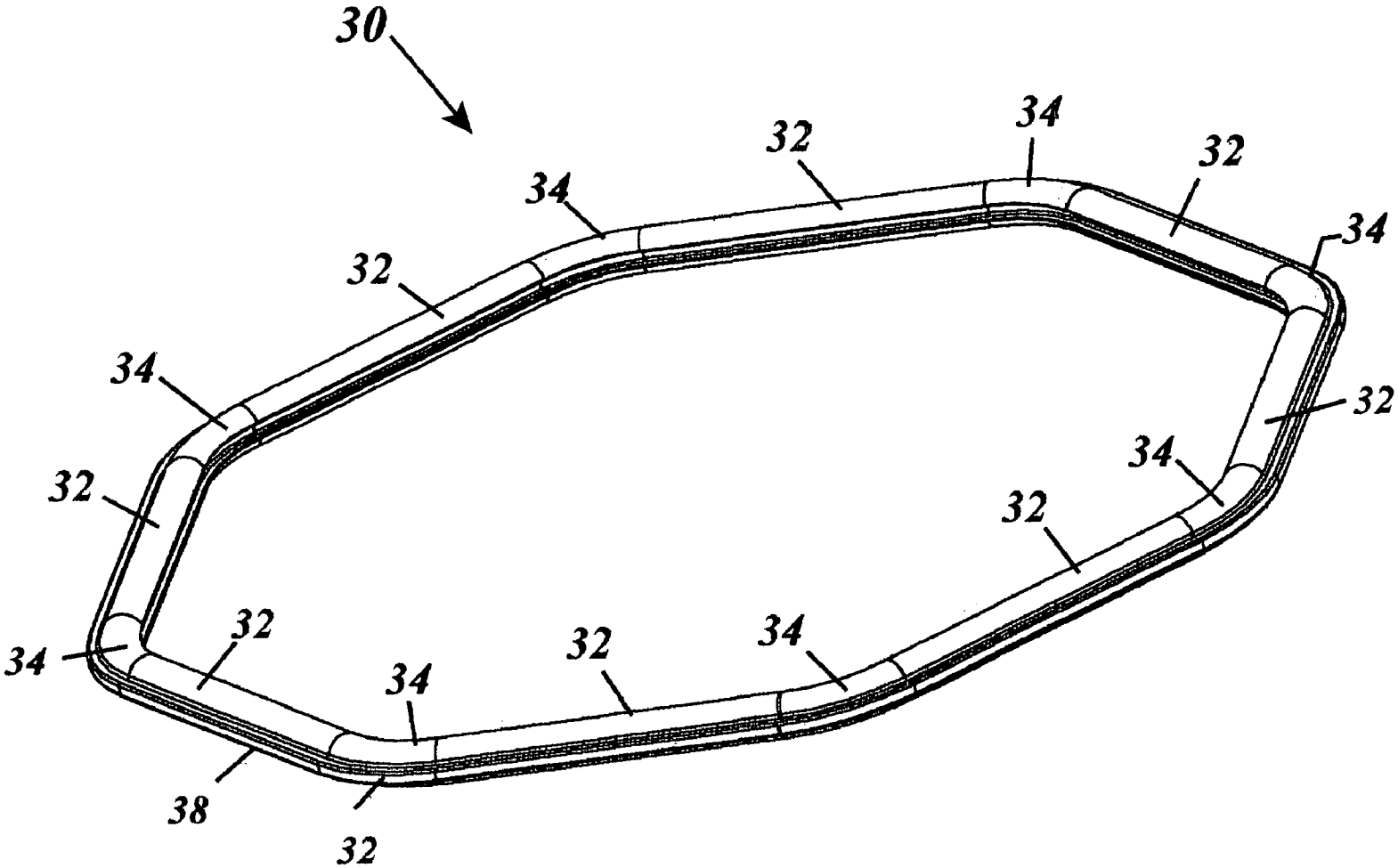
FIG. 7 is another view thereof.

FIGS. 6 and 7 depict a generally octagonal hoop configuration, generally referenced as 30, formed by sixteen (16) connected segments. The octagonal configuration includes eight (8) straight segments, referenced as 32, and eight (8) obtusely angled segments, referenced as 34 connected end-to-end by mating engagement of the component ends. As with the previously disclosed example, the hoop defines an inner recessed groove 36 and an outer projecting tongue 38 to facilitate connectability.

EXAMPLE 3

Figure 8:
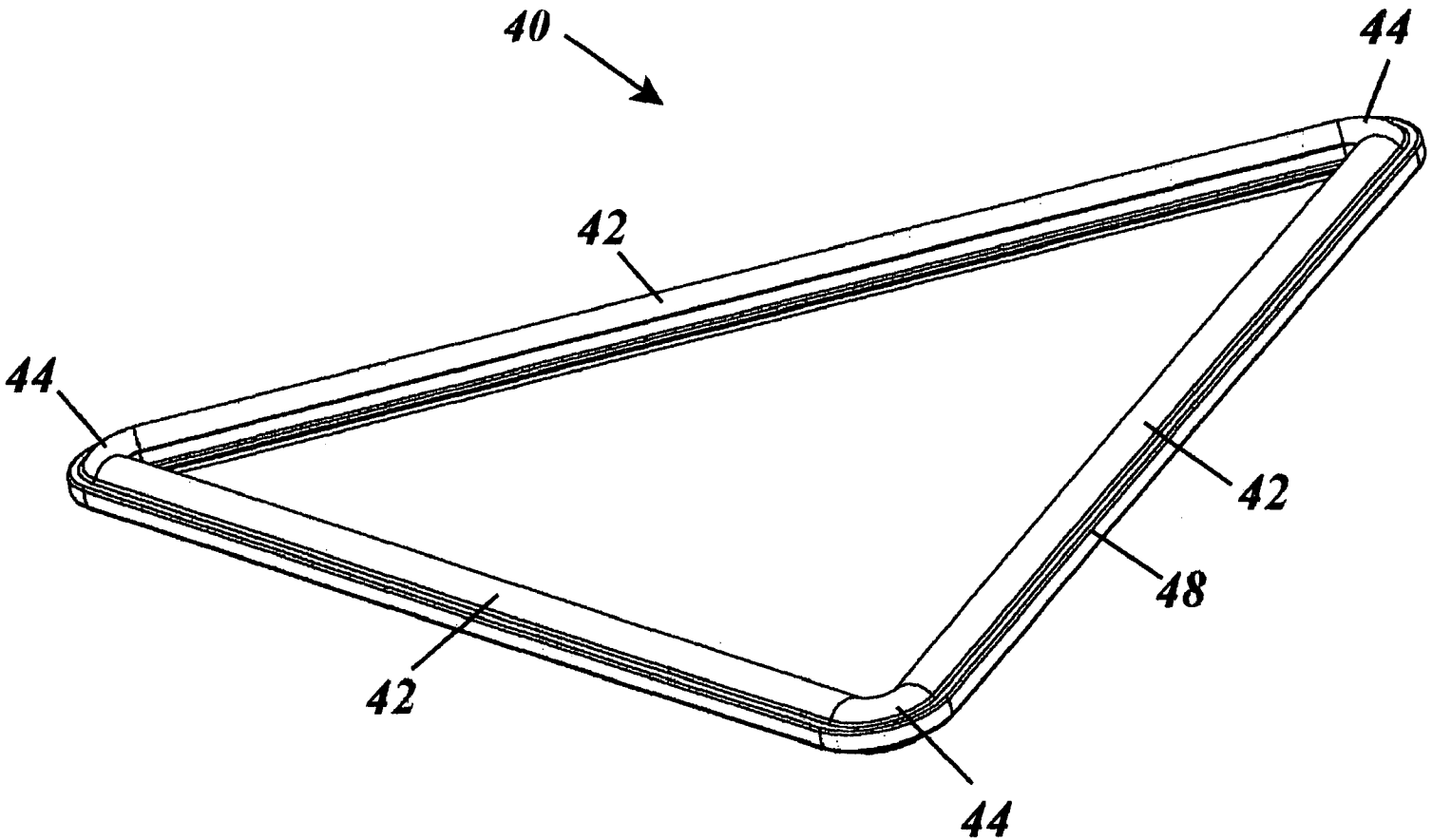
FIG. 8 is a top perspective view of a triangular hoop configuration.

FIG. 8 depicts a generally triangular hoop configuration, generally reference as 40, formed with six (6) connected segments. The triangular configuration includes three (3) straight segments, referenced as 42, and three (3) acutely angled segments, referenced as 44, connected end-to-end in mating engagement of the component ends. The various segments, further define an inner recessed groove 46 and outer projecting tongue 48 to facilitate connection with other components.

Alternate Components

Figure 9:
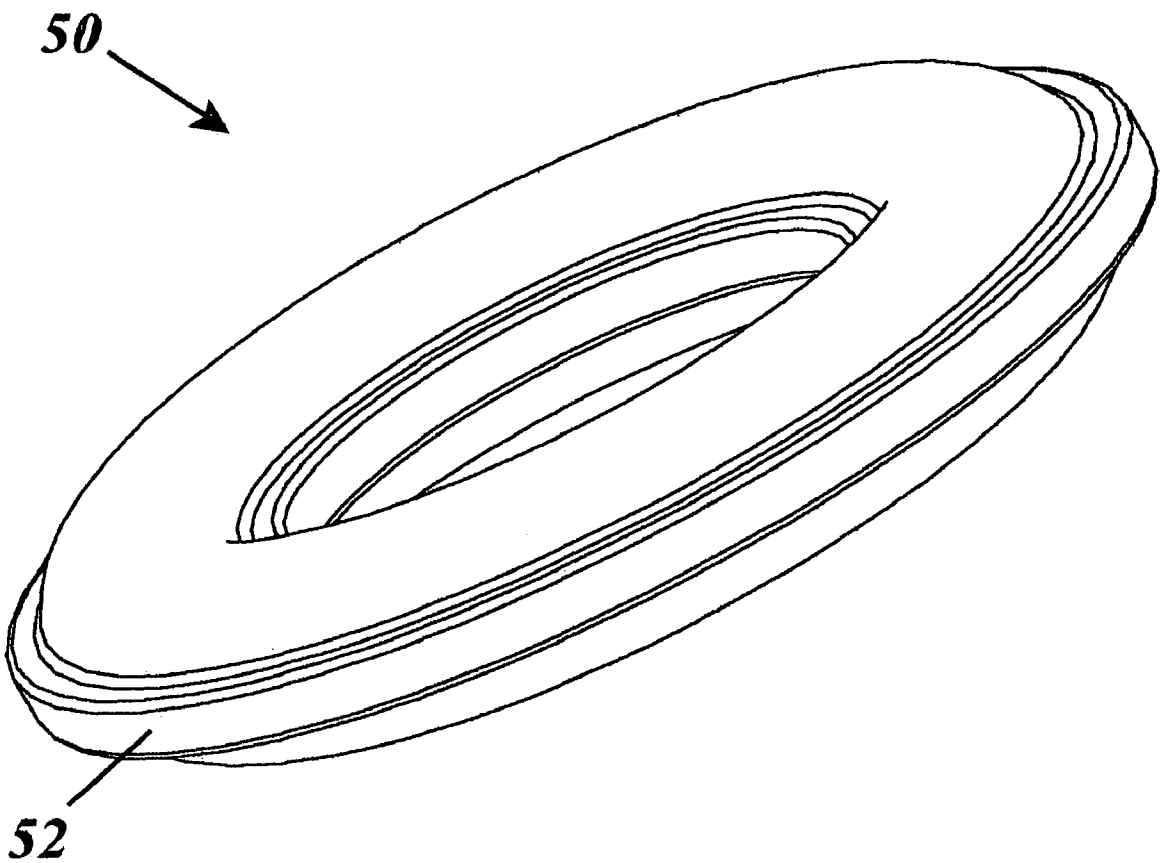
FIG. 9 is top perspective view of an annular component having a radially outer projecting circumferential tongue.
Figure 10:
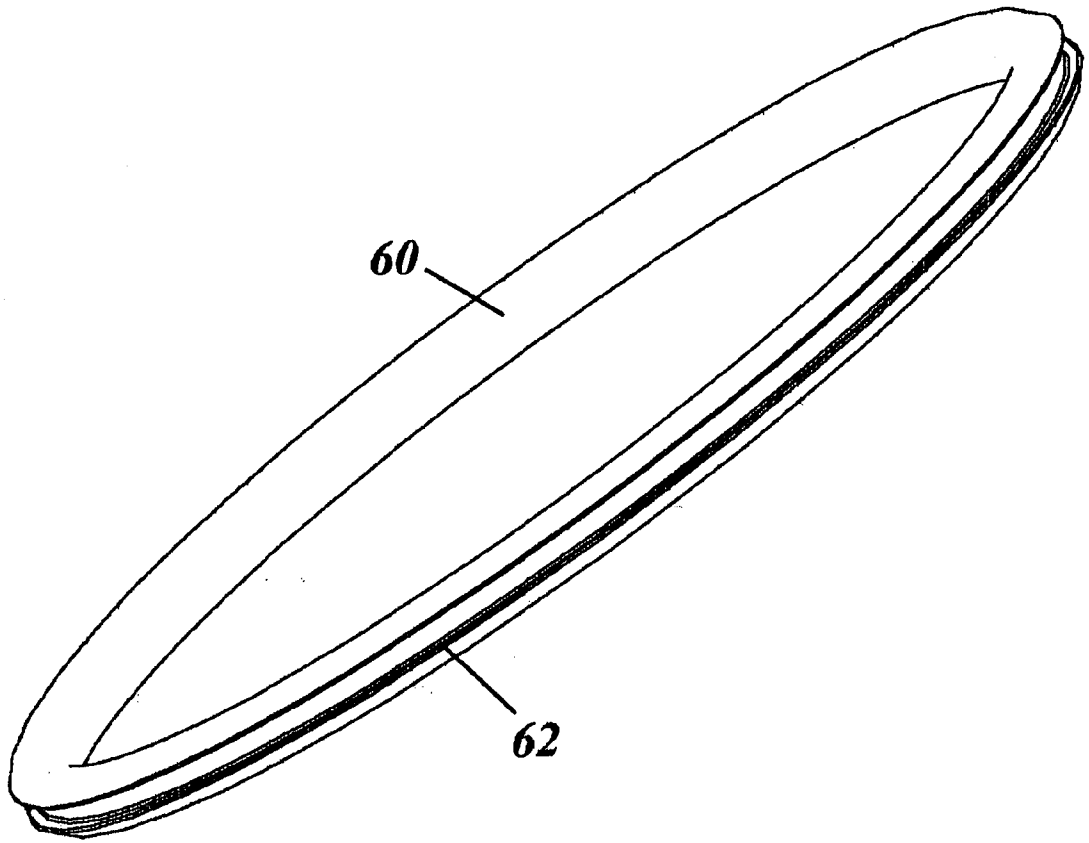
FIG. 10 is a top perspective view of another annular component having a radially outer annular groove.

FIGS. 9 and 10 depict additional components including a donut-shaped component, referenced as 50, and a ring shaped component, referenced as 60. Donut shaped component 50 is preferably a generally circular component having relatively small diameter relative to other components such as annular component 10. Component 50 has a radially outer side defining a projecting circumferential tongue 52 for use in mating engagement with corresponding grooves defined by other components. Ring shaped component 60 is preferably a generally circular component having a radially outer side defining a recessed circumferential groove 62 for use in mating engagement with corresponding tongue structures defined by other components.

Figure 11:
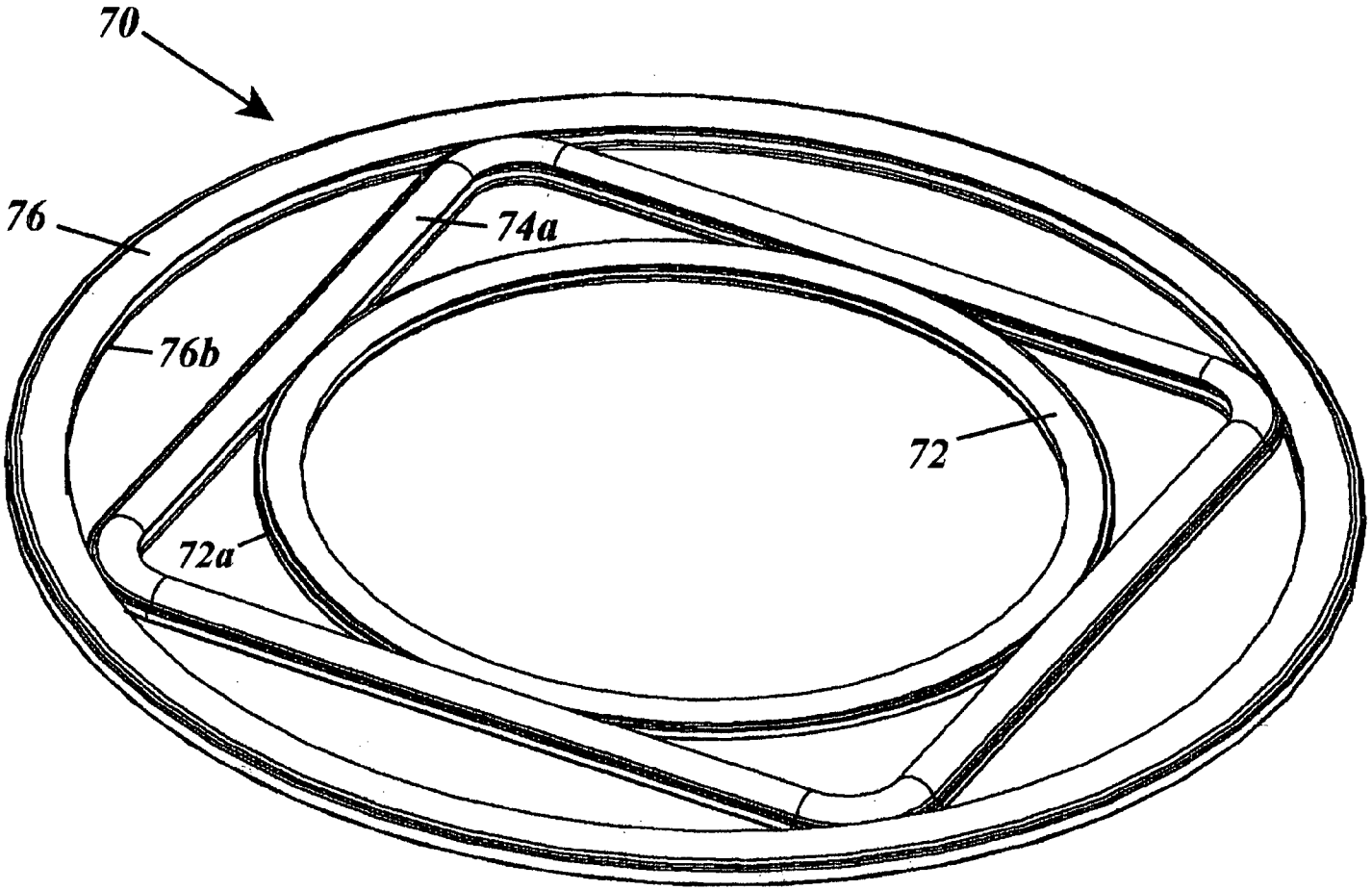
FIG. 11 is a top perspective view of one possible hula hoop configuration assembled with interconnected components according to the present invention.

FIG. 11 depicts a more complex hoop configuration, generally referenced as 70. Hoop configuration 70 includes an inner annular component 72, an intermediate square component 74, and an outer annular component 76. Annular component 72 may be fabricated from a plurality of interconnected arcuate component segments connected in end-to-end fashion, or may be a unitary circular component. As depicted in FIG. 11, component 74 is formed from four equal length straight segments and four ninety-degree angled segments. Annular component 76 may be fabricated from a plurality of interconnected acruate segments or may be a unitary annular component. Annular component 72 defines a radially outwardly projecting circumferential tongue, referenced as 72A, received within a similarly sized recessed groove, referenced as 74A, defined at the inner edge of component 74. Intermediate square component 74 includes an outer peripheral projecting tongue structure, referenced as 74B, received within a similarly sized recessed groove 76B defined at the radially inner edge of component 76.

Figure 12:
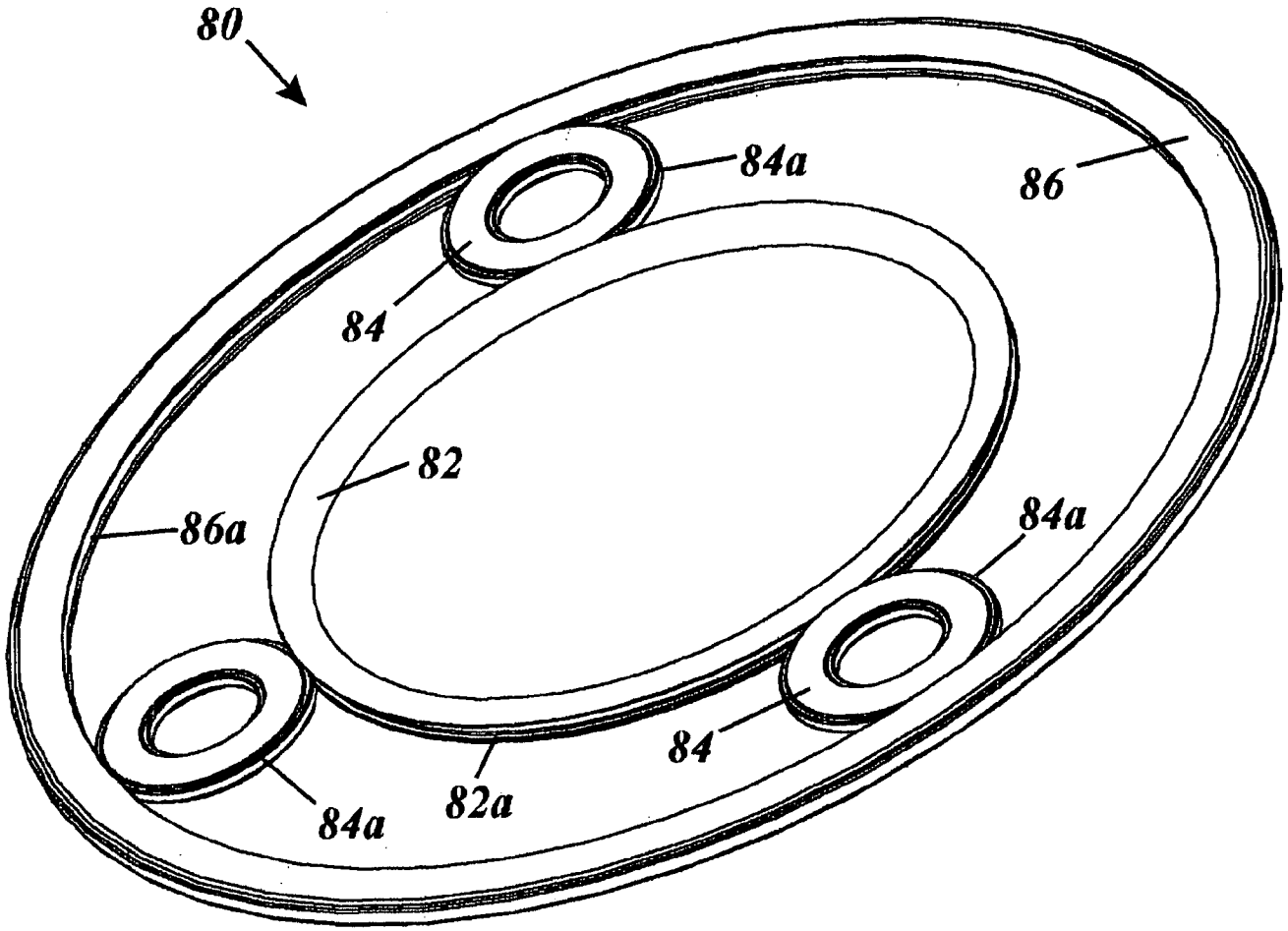
FIG. 12 is a top perspective view of another possible hula hoop configuration assembled with interconnected components according to the present invention.

FIG. 12 depicts an alternate configuration for a hoop-type amusement device, generally referenced as 80, in accordance with the present invention. Hoop configuration 80 includes an inner annular component 82 (referenced as 60 in FIG. 10), a plurality of intermediate annular components 84 (referenced as 50 in FIG. 9), and an outer annular component 86 (referenced as 10 in FIG. 1). Inner annular component 82 defines a radially outer surface defining a recessed groove 82A, in mating engagement with circumferentially projecting tongue structures 84A defined by intermediate annular components 84. Outer annular component 86 defines a radially inner recessed groove, referenced as 86A, in mating engagement with projecting tongue structures 84A on components 84.

Figure 13:
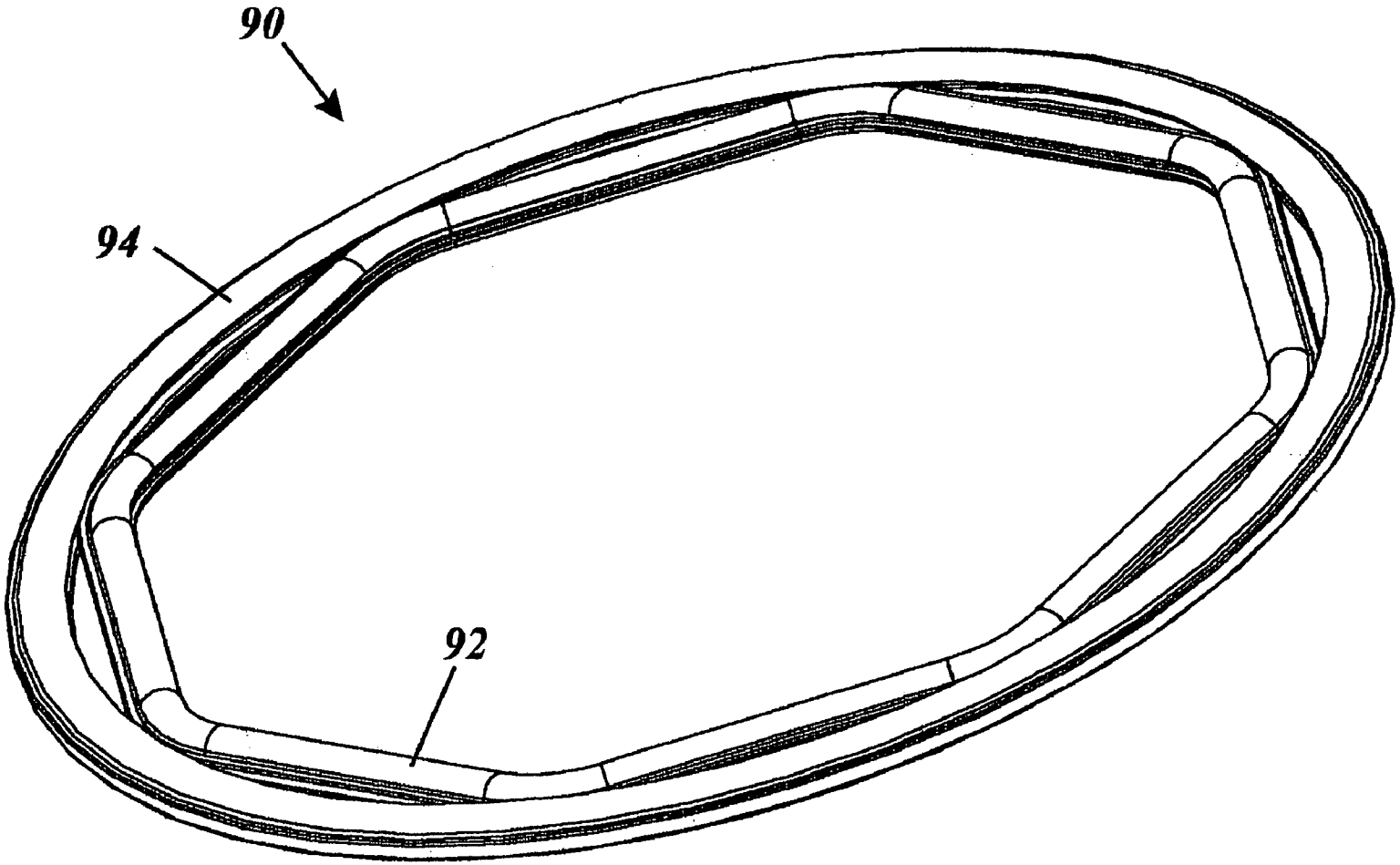
FIG. 13 is a top perspective view of another possible hula hoop configuration assembled with interconnected components according to the present invention.

FIG. 13 depicts another possible configuration for a hoop-type amusement device, generally referenced as 90. Hoop configuration 90 includes an inner octagonal component, referenced as 92 and an outer annular component, referenced as 94 (similar to component 10 depicted in FIG. 1). Inner octagonal component 92 is formed by sixteen (16) connected segments, including eight (8) straight segments, and eight (8) obtusely angled segments connected end-to-end by mating engagement of the segment ends.

Figure 14:
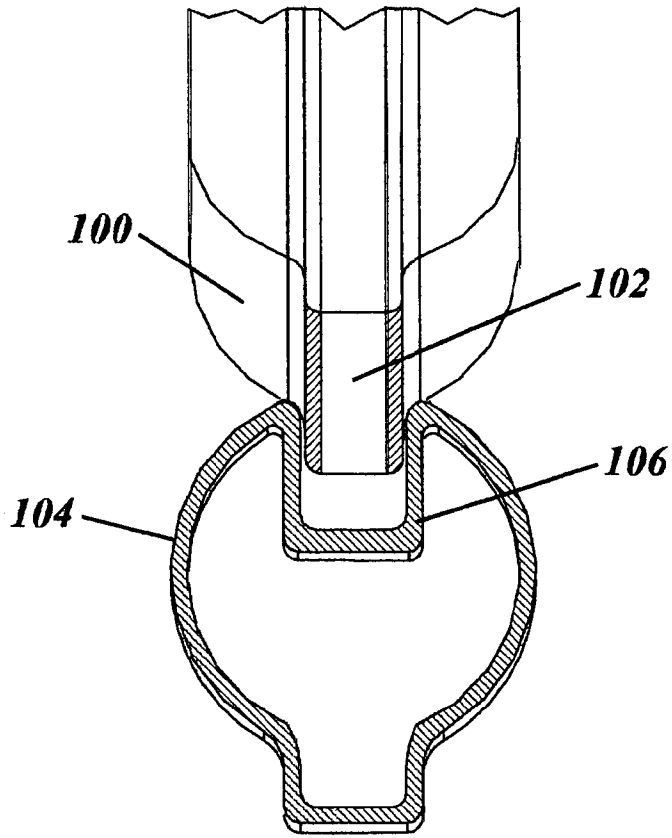
FIG. 14 is a partial partial side view illustrating the connection of components by tongue and groove engagement.

FIG. 14 illustrates in more detail the tongue and groove connection of selected components. More particularly, a first component 100 having an outer side defining a projecting tongue 102 is positioned for mating engagement with a second component 104 having a side defining a recessed groove 106. Insertion of tongue 102 into groove 106 results in removable mating engagement of the various components.

As should be apparent, the various components may be connected to form a virtually endless variety of complex hoop configurations thereby enhancing enjoyment.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What I claim is:

1. A hoop-type amusement apparatus comprising:

a first hoop component having a radially inner surface defining a circumferential recessed groove;

a plurality of connectable components, including annular components and non-annular components, said connectable components including at least one component having a first side defining a projecting tongue and a second side defining a recessed groove;

whereby complex hoop configurations may be selectively assembled by a user by connection of said connectable components in tongue and groove mating engagement.

2. A hoop-type amusement apparatus according to claim 1, wherein said first hoop component is annular.

3. A hoop-type amusement apparatus according to claim 1, wherein said plurality of connectable components include at least one annular component and at least one component selected from the group consisting of: square components, triangular components, and octagonal components.

4. A hoop-type amusement system comprising:

a plurality hoop components, including annular and non-annular components, each of said hoop components including at least one projecting tongue or at least one projecting groove;

said plurality of hoop components including an annular hoop component having a radially inner edge defining a circumferential groove, and at least one non-annular hoop component having an outer edge defining a projecting tongue, said non-annular hoop component sized for mating engagement with said annular hoop component by tongue and groove connection;

said plurality of hoop components including components sized for mating tongue and groove engagement with other of said plurality of hoop components, whereby a variety of complex hoop configurations may be formed by selective engagement of at least two of said plurality of hoop components.

5. A hoop-type amusement apparatus comprising:

a first hoop component having a radially inner surface defining a circumferential recessed groove;

a plurality of connectable components including at least one component having a first side defining a projecting tongue and a second side defining a recessed groove;

whereby complex hoop configurations may be selectively assembled by connection of said connectable components in tongue and groove mating engagement.

* * * * *